US009034811B1

(12) United States Patent
Molnar et al.

(10) Patent No.: US 9,034,811 B1
(45) Date of Patent: May 19, 2015

(54) FORMULATION FOR CLEANING OF HARD SURFACES AND TEXTILES

(71) Applicants: David Edward Molnar, Rockwall, TX (US); Peter McLean Harrison, Clear Lake, IA (US)

(72) Inventors: David Edward Molnar, Rockwall, TX (US); Peter McLean Harrison, Clear Lake, IA (US)

( * ) Notice: Subject to any disclaimer, the term of this patent is extended or adjusted under 35 U.S.C. 154(b) by 0 days.

(21) Appl. No.: 14/074,891

(22) Filed: Nov. 8, 2013

(51) Int. Cl.
*C11D 1/66* (2006.01)
*C11D 3/34* (2006.01)
*C11D 3/20* (2006.01)

(52) U.S. Cl.
CPC ..... *C11D 3/34* (2013.01); *C11D 3/2065* (2013.01); *C11D 3/2068* (2013.01); *C11D 3/2093* (2013.01)

(58) Field of Classification Search
CPC ..... C11D 1/66; C11D 3/2041; C11D 3/2065; C11D 3/2093
USPC ..... 510/338, 340, 342, 353, 356, 357, 413, 510/414, 432, 437; 8/137
See application file for complete search history.

(56) References Cited

U.S. PATENT DOCUMENTS 6,191,087 B1 * 2/2001 Opre et al. ..... 510/201
7,687,084 B2 3/2010 Tien et al.
8,206,761 B2 6/2012 Kutumian
2003/0125223 A1 * 7/2003 Denton ..... 510/130
2006/0216365 A1 9/2006 Nassif et al.

OTHER PUBLICATIONS

"BCS Powdered Caustic Cleaner HD M.S.D.S.", Material Safety Data Sheet, Basic Chemical Solutions, American Tartaric Products, Oct. 19, 1998, URL: http://www.americantartaric.com/pdf/BCS0525%20POWDERED%20CAUSTIC%20CLEANER%20HD%20MSDS.pdf, 8 pages.
Mrs. Meyer's Clean Day Household Cleaners online order site, The Caldrea Company, 2013, URL: http://www.mrsmeyers.com/category/Product/Household-Cleaners/pc/2155/2172.uts.

* cited by examiner

*Primary Examiner* — Brian P Mruk
(74) *Attorney, Agent, or Firm* — Carstens & Cahoon, LLP

(57) ABSTRACT

Concentrated cleaning formulations for removing debris from hard surfaces and textile surfaces. An exemplary formulation includes a mixture of the following chemical components, in specified proportions:

glycerin;
monopropylene glycol;
triethylene glycol methyl ether;
a non-ionic surfactant;
an emulsifier;
soya methyl ester or canola methyl ester, or both; and
hydroxypropyl sulfonate;

The formulation is free of water other than insignificant amounts present in the chemical components combined to make the mixture. Combining the formulation with water causes a temperature of the combination to increase above the temperatures of the water and the formulation before combining.

20 Claims, 2 Drawing Sheets

AATOR.0103

(2/2)

FORMULATION FOR CLEANING OF HARD SURFACES AND TEXTILES

BACKGROUND

1. Field of the Invention

This invention relates to the field of chemical compositions, and more particularly to liquid chemical compositions that comprise several chemical components, and that are used as surface cleaners to remove stains, dirt, and other undesirable debris from hard surfaces as well as textile surfaces.

2. Description of the Related Art

There are a wide variety of methods and compositions available today for the purpose of cleaning surfaces. Several of the cleaning compositions are specialized, and are directed toward specific cleaning tasks. For example, cleaners may include a scouring powder, and these may be developed for the specific purpose of cleaning cooking utensils where the scouring powder facilitates removal of hardened cooking residues from surfaces. Other specialized cleaners have been developed to clean carpets, to clean kitchen counter tops, to wash cars, and for a multitude of other uses.

In general, many of the cleaners are water-based ("aqueous") and have an action that facilitates dissolving the debris ("ink, dyes, toner, stains, dirt, food residue, or any other undesirable composition to be removed") in water so that the debris may be readily removed. Since not all debris types are water-soluble, and sometimes cannot be readily solubilized, some cleaning compositions are non-aqueous, and may be based on alcohol. Alcohol is a more polar solvent than water, and alcohol-based cleaning liquids may be useful to remove debris that is alcohol soluble from surfaces. In yet other applications, the liquid cleaner may be a hydrocarbon-based composition, such as for example the cleaning fluids used in the "dry cleaning" process to clean clothing.

In carpet cleaning, there are several methods in common use. These include dry cleaning which uses fast drying chemical mixtures that are characterized as very low moisture ("VLM") systems. Heavily soiled carpet areas are often pretreated with detergents, emulsifiers, and solvents such as D-limonene, and petroleum-based products. Other techniques include the use of dry carpet shampoo, or wet shampoo with rotary machines, followed by vacuuming the affected area.

For surfaces, such as kitchen or bath room surfaces, it is often desirable that the surface also be cleaned of microbes and/or fungi. Such sanitization/sterilization of surfaces may be achieved by applying a cleaning composition that includes a biocide, or that has a pH in the range that will kill pathogens.

In general, while some cleaning compositions may be "multi-purpose" and can theoretically be used, for example, in bath rooms as well as kitchens, most are marketed for a single purpose, and most are formulated with that particular purpose in mind. Variations of the composition used for cleaning floors may be sold, under a different name, for cleaning bath room marble counter tops, for example.

SUMMARY

The following is a summary of some aspects and exemplary embodiments of the present technology, of which a more detailed explanation is provided under the Detailed Description section, here below.

An exemplary embodiment provides a concentrated cleaning formulation for removing debris from hard surfaces and textile surfaces. The formulation has a mixture of the following chemical components:

glycerin;
monopropylene glycol;
triethylene glycol methyl ether;
a non-ionic surfactant;
an emulsifier;
soya methyl ester or canola methyl ester, or both; and
hydroxypropyl sulfonate;

wherein the formulation is free of water other than insignificant amounts present in the chemical components combined to make the mixture, and wherein combining the formulation with water causes a temperature of the combination to increase above the temperatures of the water and the formulation before combining.

Optionally, the exemplary cleaning formulation may include about 15 to about 25 wt. % glycerin.

Optionally, the exemplary cleaning formulation may include about 15 to about 25 wt. % triethylene glycol methyl ether.

Optionally, the exemplary cleaning formulation may include 15 to about 25 wt. % non-ionic surfactant.

Optionally, the exemplary cleaning formulation may include about 15 to about 25 wt. % monopropylene glycol.

Optionally, the exemplary cleaning formulation may include about 8 to about 15 wt. % methyl ester.

Optionally, the exemplary cleaning formulation may include about 3 to about 8 wt. % of the emulsifier. And, optionally, the exemplary emulsifier may be selected from soybean-based emulsifiers.

Optionally, the exemplary cleaning formulation may include about 3 to about 8 wt. % hydroxypropyl sulfonate. And, optionally, the non-ionic surfactant may be selected from sodium decylglucoside and sodium laurylglucoside.

Optionally, the exemplary cleaning formulation may further include a fragrance.

Another exemplary embodiment provides a concentrated cleaning formulation for removing debris from hard surfaces and textile surfaces. The formulation comprising a mixture of the following chemical components:

about 15 to about 25 wt. % glycerin;
about 15 to about 25 wt. % monopropylene glycol;
about 15 to about 25 wt. % triethylene glycol methyl ether;
about 15 to about 25 wt. % of a non-ionic surfactant;
about 3 to about 8 wt. % of an emulsifier;
about 3 to about 8 wt. % of soya methyl ester, or about 3 to about 8 wt. % of canola methyl ester, or about 3 to about 8 wt. % of both; and
about 3 to about 8 wt. % hydroxypropyl sulfonate;

wherein the formulation is free of water other than insignificant amounts present in the chemical components combined to make the mixture, and wherein combining the formulation with water causes a temperature of the combination to increase above the temperatures of the water and the formulation before combining.

Optionally, exemplary embodiments may include about 20 wt. % of any or all of glycerin, monopropylene glycol, and triethylene glycol methyl ether.

Optionally, exemplary embodiments may include about 18.5 wt. % of the non-ionic surfactant.

Optionally, exemplary embodiments may include about 10 wt. % of the methyl ester.

Optionally, exemplary embodiments may include about 5 wt. % of hydroxypropyl sulfonate; and optionally the non-ionic surfactant is selected from sodium decylglucoside and sodium laurylglucoside.

Optionally, the exemplary embodiments may include about 5 wt. % emulsifier, which is further optionally, soy-based.

Exemplary embodiments of the cleaning formulations may be packaged in a variety of way. For example, the cleaning formulations may be contained in squeeze bottles or spray bottles, or may be sold in bulk in large plastic containers. When diluted with water, the temperature of the water-formulation mixture rises. It is theorized without being bound that this is due to exothermic heat of dissolution. Dilution of one volume of the cleaning formulation with an equal volume of water results in a temperature increase of the mixture of about 20° C.

Methods of making and using the cleaning formulations are detailed here below. In general, water is excluded from the exemplary concentrated formulations, and any water present in detectable quantity may originate from the chemical components that are mixed and blended together to make the concentrated formulations, or from equipment of the environment. Water is not added to the exemplary concentrated cleaning formulations. Of course, water may be added to diluted versions.

The foregoing summary is not exhaustive; more details and exemplary embodiments about the concentrated cleaning formulation technology that is the subject of the appended claims are provided here below.

BRIEF DESCRIPTION OF THE DRAWINGS

Various embodiments will be described in conjunction with the following drawings which are schematic, not to scale, and wherein like numerals denote like elements. The technology may be more easily understood by reference to the following Detailed Description, and when read in conjunction with the accompanying illustrative, not-to-scale drawings.

DETAILED DESCRIPTION OF EXEMPLARY EMBODIMENTS

Figure 1:
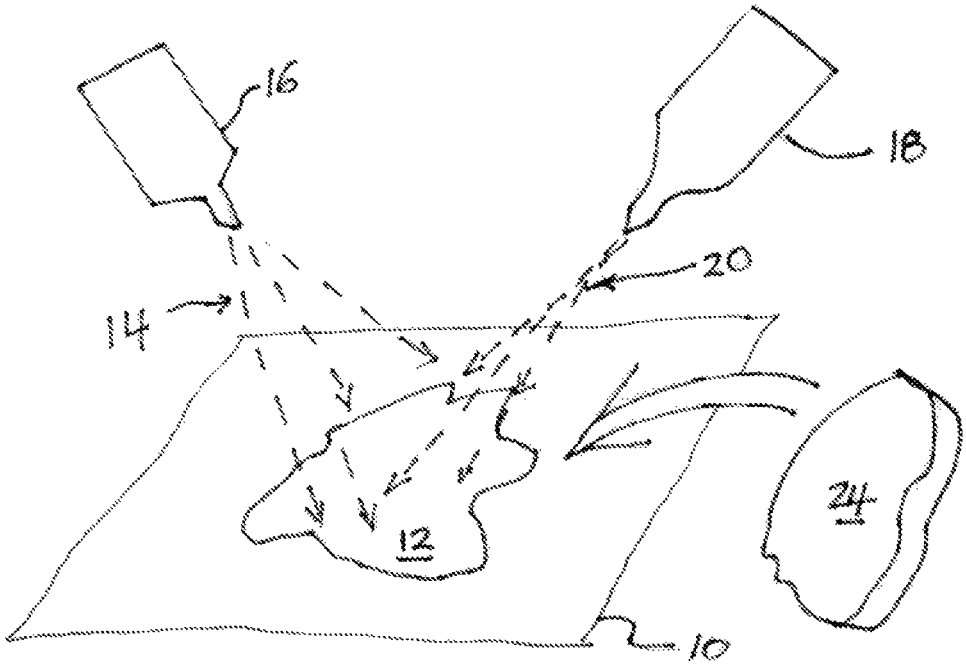
FIG. 1 is a schematic depiction of a mode of use of an exemplary embodiment of the concentrated cleaning formulation.

The following provides a detailed description of exemplary embodiments of the cleaning formulations, methods of making these formulations and methods of using these formulations. It should be understood that describing examples of these embodiments facilitates an understanding of the inventions, but the exemplary embodiments do not limit the scope of the inventions in any respect. The inventions are demarcated only by the claims appended here below.

The term "exemplary" as used herein, means "an example of," and the examples provided herein are non-limiting of the invention, which is solely expressed in the patent claims.

In the specification and claims, the term "debris" means undesirable residue on a surface and includes, without limitation, ink, dye, stains, toner residue, dirt, grass stains, wine stains, blood, food, and grease. Sometimes at least a portion of that residue remains tightly bound to the surface, even after a standard cleaning procedure, appropriate to that surface, has been applied. The term "non-toxic," as used in the specification and claims means cleaning formulation residues on surfaces that are present in such minute and barely detectible residual amounts, if any, on cleaned surfaces as to pose virtually no risk to human health, if ingested in food or drink in contact with that surface. The term "sanitizing" as used in the specification and claims relates to the capability of embodiments of the cleaning formulations to clean surfaces having a micro-organism (pathogens, fungi, etc.) load associated with that residue, to thereby significantly reduce the population of the micro-organism and any associated risk.

The cleaning formulations may be used on hard surfaces as well as textiles. Accordingly, the cleaning formulations may be used, without limitation, on ceramic or synthetic tiles, metals, hard plastics, decorative laminates, and stone surfaces. In addition, the cleaning formulations may be used on textiles, including without limitation, carpets that include wool, cotton, silk, and other natural and synthetic fibers.

An exemplary embodiment provides a concentrated cleaning formulation for removing debris from hard surfaces and textile surfaces. The formulation has a mixture of the following chemical components:

- glycerin;
- monopropylene glycol;
- triethylene glycol methyl ether;
- a non-ionic surfactant;
- an emulsifier;
- a methyl ester, for example, soya methyl ester or canola methyl ester, or both; and hydroxypropyl sulfonate;
- a fragrance, if necessary, to provide an attractive scent to mask the smell of chemicals.

The concentrated cleaning formulation is free of added water, other than insignificant amounts that were present in the chemical components, as supplied by the vendor, that were combined to make the mixture.

Exemplary embodiments may vary in composition based on the relative proportions of the above-listed chemical components. Thus, for example, in an embodiment, the weight percent (wt. %) of glycerin may vary from about 15 to about 25%. Substitutes for glycerin include, but are not limited to glyceryl caprylate/caprate, ethyl hexyl glycerin, polybutylene glycol, and polyethylene glycol.

In the same, or another embodiment, monopropylene glycol may vary from about 15 to about 25 wt. %. Moreover, 1,2 dihydroxypropane; 1,2-propanediol; and/or 1,2 propylene glycol may be used to substitute for some or all of the monopropylene glycol. Other substitutes include, but are not limited to polyethylene glycol, polybutane glycol, ethyl hexyl glycerin, pentylene glycol, sorbitol, xylitol, hexanediol, butylene glycol, and hexylene glycol.

In the same, or another embodiment, the solvent triethylene glycol methyl ether ("TEGME") may vary from about 15 to about 25 wt. %. Moreover, substitutes for some or all of the TEGME include but are not limited to pentylene glycol, methyl gluceth, glycereth, dipropylene glycol methyl ether, polyester glycol, polyglycerin, hexanediol, tripropylene glycol n-butyl ether, propylene glycol diacetate.

Further, for example, embodiments of the concentrated cleaning formulation may include 15 to about 25 wt. % non-ionic surfactant. The non-ionic surfactants include, but are not limited to the commercial surfactants Polysorbate 20 (Polyoxyethylene (20) sorbitan monolaurate) (Polysorbate is a trademark of ICI Americas), Polysorbate 80 (Polyoxyethylene (20) sorbitan monooleate), Poysorbate 60 (Polyoxyethylene (20) sorbitan monostearate), glucoside derivatives (e.g. decyly glucoside, coco glucoside, lauryl glucoside, and the like), polyethylene glycols and their derivatives, alcohol ethoxylate, amine oxides, amine derivatives, sorbitan derivatives (e.g. sorbitan monostearate), ethoxylates (e.g. alkylphenol ethoxylates, nonyl phenol ethoxylate, and the like).

The exemplary cleaning formulation may include from about 8 to about 15 wt. % methyl ester. The methyl esters may include, but are not limited to canola methyl ester, soy methyl ester, and methyl palmitate/oleate.

The exemplary cleaning formulation may include from about 3 to about 8 wt. % of the emulsifier. The exemplary emulsifier used may include, but is not limited to the soybean-based emulsifiers, and alcohol ethoxylates.

The exemplary concentrated cleaning formulation may include about 3 to about 8 wt. % hydroxypropyl sulfonate as a gentle surfactant boosting agent and emulsifier. Other useful substitutes include, but are not limited to, sodium decylglucoside, sodium laurylglucoside, polyethylene glycol with average molecular weight of 0-10K, sorbitan esters, and sodium hydroxide or potassium hydroxide reacted with base oils to create soaps.

The optional fragrance may be selected from any of a variety of fragrances that are appealing and that will significantly if not completely mask chemical odor from the concentrated cleaning formulations. Such fragrances are well known and include oregano oil, lavender oil, citrus oil, and the like, without limitation.

The concentrated cleaning formulations are anhydrous, in the sense of having no added water. However, it is recognized that several of the chemical components may include water in small and insignificant amounts due to their manufacturing processes and specifications as commercially available chemical products. This water is insufficient to cause the temperature increase observed when the cleaning formulation is diluted. Thus, from a practical standpoint, the exotherm is not "exhausted" when such insignificant amounts of water are added as entrained moisture in chemical components. Rather, the dilution of the concentrated cleaning formulation in a ratio of cleaning formulation:water of from about 1:1 to about 1:1.5 results in a temperature increase of about 20° C. Thus, if the concentrated formulation and the dilution water are each at about 45° C., the resultant temperature would increase to 65° C. This is a temperature that would cause scalding, with second degree burns, if maintained on ungloved, exposed human skin for more than 3 seconds, but is a temperature at which many of the more common pathogens encountered in a residential environment are killed. Accordingly, protective gloves should be worn if application and treatment require manual intervention, unless a sufficient time delay after dilution is allowed to permit the diluted mixture (and surfaces to which it was applied) to cool to a safer temperature before manual intervention. If mechanical application is used, such precautions may not be necessary. Furthermore, if "cold tap water" at 20° C. is used, then the resultant diluted cleaning formulation would only be at 40° C., which is well below a scalding temperature. [At 49° C. it takes 8 minutes of exposure to cause a second degree burn.]

An exemplary method of removing debris from a surface is illustrated in FIG. 1 where debris 12 on a surface 10, such as the surface of a carpet or a kitchen counter top, may be treated by dousing the debris 12 with a measured (or estimated) amount of concentrated cleaning formulation 14 from a squeeze bottle (or a pump bottle) 16. Thereafter, water 20 is applied to the doused debris 12 from a second bottle 18. At this point heat is evolved and the treated area heats up. When safe to do so, an applicator 12 such as a sponge or cloth, may be used to wipe the treated surface area 10 clean of the debris 12, which should readily come off the surface 10.

Clearly, a variety of other methods can be used as well. For example, in the exemplary method described above, the water could be added first, if the debris is dry and "caked on." Moreover, the applicator could also be a brush or other device that provides mechanical action to remove hardened debris. Further, the treated debris could be rinsed off rather than wiped off.

In general, the concentrated cleaning formulations may be used to clean surfaces by adapting the same methods and equipment as used with other cleaning liquids, taking into account, however, the evolution of heat upon dilution, and the sanitizing effect of that heat.

In another exemplary embodiment, the concentrated cleaning formulation has basic and novel aspect that arises from the very specific proportions of each component chemical in the mixture. In this embodiment, the concentrated cleaning formulation includes:

about 20 wt. % glycerin;

about 20 wt. % monopropylene glycol;

about 20 wt. % triethylene glycol methyl ether;

about 18.5 wt. % non-ionic surfactant;

about 5 wt. % of an emulsifier;

about 10 wt. % soya methyl ester or canola methyl ester, or both; and about 5 wt. % hydroxypropyl sulfonate; and about 1.5 wt. % fragrance.

The formulation is free of water other than insignificant amounts present in the chemical components combined to make the mixture. Combining the formulation with water causes a temperature of the combination to increase above the temperatures of the water and the formulation before combining Dilution of the concentrated cleaning formulation in a ratio of cleaning formulation:water of from about 1:1 to about 1:1.5 results in a temperature increase of about 20° C.

Figure 2:
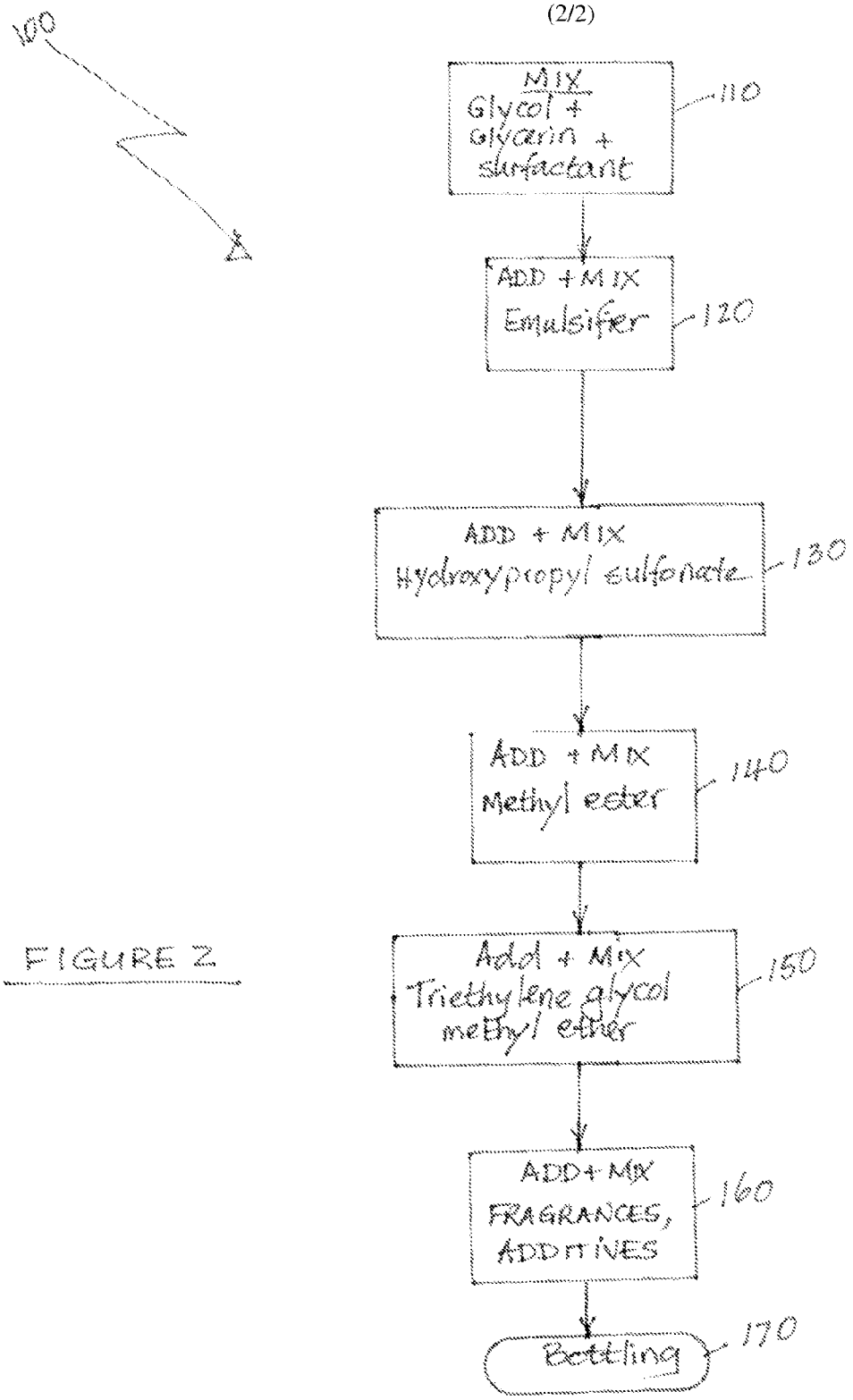
FIG. 2 is a flow chart depicting the exemplary steps in making an embodiment of the concentrated cleaning formulation.

Exemplary methods of making the concentrated cleaning formulations take into account that several of the components may not be miscible with each other. Accordingly, to provide a uniformly mixed formulation, the steps of making the formulation should be adapted to ensure a homogeneous mixture. An exemplary method of mixing the chemical components into a batch of concentrated cleaning liquid formulation is illustrated in the flow chart 100 of FIG. 2. In the first step 110, the glycerin and glycol is combined with the surfactant and mixed. Once blended, the emulsifier is added in step 120, and mixed in. Thereafter, in step 130, the hydroxypropyl sulfonate is added, and mixed in. Next, in step 140, the methyl ester is mixed into the batch. The TEGME is added and mixed in, in step 150. Finally, the fragrance may be added in step 160. The prepared batch may now be bottled or otherwise packaged in step 170. This order is preferred but other orders of addition and mixing may be used.

In an exemplary embodiment, the glycerin and propylene glycol (with optional triethylene glycol) are blended together at about 20-40° C. Surfactant is added while mixing continues and the temperature is maintained. After about 5 to 10 minutes of mixing, soybean emulsifier is added while mixing for a further period of about 5-10 minutes and maintaining temperature. Next, hydroxypropyl sulfonate is added, and mixing continues for about 5 to 10 minutes. Next, methyl ester is added, and mixed in for about 5-10 minutes. The triethylene glycol methyl ether is then added, while mixing continues for about 5 to 20 minutes. Throughout, the temperature is maintained at about 20-40° C. At this stage, additives, such as fragrances, may be added and blended with the active components of the formulation.

The foregoing provides exemplary methods of making the concentrated cleaning formulation in a batch process. Other processes, such as a continuous blending process, may also be used. The sequence of component addition provided in the above exemplary process to produce a homogeneous mixture is exemplary, and other sequences may also be feasible.

While at least one exemplary embodiment has been presented in the foregoing detailed description section, it should be appreciated that many variations exist. It should also be appreciated that the exemplary embodiments are only examples, and are not intended to, and do not, limit the scope, applicability, or configuration of the claimed inventions in any way. Rather, the foregoing detailed description provides a convenient road map for those of ordinary skill in the art to implement exemplary embodiments. It should be understood that various changes can be made in the function and arrangement of elements described herein without departing from the scope of the patent claims listed below, including the legal equivalents of these patent claims.

The invention claimed is:

1. A concentrated cleaning formulation for removing debris from hard surfaces and textile surfaces, the formulation comprising a mixture of the following chemical components:

a first component selected from the group consisting of glycerin, glyceryl caprylate/caprate, ethyl hexyl glycerin, polybutylene glycol, and polyethylene glycol;

a second component selected from the group consisting of monopropylene glycol, 1,2 dihydroxypropane; 1,2-propanediol; and/or 1,2 propylene glycol, polyethylene glycol, polybutane glycol, ethyl hexyl glycerin, pentylene glycol, sorbitol, xylitol, hexanediol, butylene glycol, and hexylene glycol;

a third component selected from the group consisting of triethylene glycol methyl ether, pentylene glycol, methyl gluceth, glycereth, dipropylene glycol methyl ether, polyester glycol, polyglycerin, hexanediol, tripropylene glycol n-butyl ether, and propylene glycol diacetate;

a non-ionic surfactant;

an emulsifier;

a methyl ester selected from soya methyl ester or canola methyl ester; and a fourth component selected from the group consisting of hydroxypropyl sulfonate, sodium decylglucoside, sodium laurylglucoside, polyethylene glycol with average molecular weight of 0-10K, soaps, and sorbitan esters;

wherein the formulation is free of water other than insignificant amounts present in the chemical components combined to make the mixture, and wherein combining the formulation with water causes a temperature of the combination to increase above the temperatures of the water and the formulation before combining.

2. The cleaning formulation of claim 1, comprising about 15 to about 25 wt. % of the first component.

3. The cleaning formulation of claim 1, comprising about 15 to about 25 wt. % of the third component.

4. The cleaning formulation of claim 1, comprising about 15 to about 25 wt. % of the non-ionic surfactant.

5. The cleaning formulation of claim 1, comprising about 15 to about 25 wt. % of the second component.

6. The cleaning formulation of claim 1, comprising about 8 to about 15 wt. % of the methyl ester.

7. The cleaning formulation of claim 1, comprising about 3 to about 8 wt. % of the emulsifier.

8. The cleaning formulation of claim 7, wherein the emulsifier is selected from soybean-based emulsifiers.

9. The cleaning formulation of claim 1, comprising about 3 to about 8 wt. % of the fourth component.

10. The cleaning formulation of claim 9, wherein the fourth component is selected from sodium decylglucoside and sodium laurylglucoside.

11. The cleaning formulation of claim 1, further comprising a fragrance.

12. A concentrated cleaning formulation for removing debris from hard surfaces and textile surfaces, the formulation comprising a mixture of the following chemical components:

about 15 to about 25 wt. % glycerin;

about 15 to about 25 wt. % monopropylene glycol;

about 15 to about 25 wt. % triethylene glycol methyl ether;

about 15 to about 25 wt. % of a non-ionic surfactant;

about 3 to about 8 wt. % of an emulsifier;

about 3 to about 15 wt. % of soya methyl ester, or about 3 to about 15 wt. % of canola methyl ester, or about 3 to about 15 wt. % of both;

about 3 to about 8 wt. % hydroxypropyl sulfonate; and optionally a fragrance;

wherein the formulation is free of water other than insignificant amounts present in the chemical components combined to make the mixture, and wherein combining the formulation with water causes a temperature of the combination to increase above the temperatures of the water and the formulation before combining.

13. The cleaning formulation of claim 12, comprising about 20 wt. % of the glycerin.

14. The cleaning formulation of claim 12, comprising about 20 wt. % of the triethylene glycol methyl ether.

15. The cleaning formulation of claim 12, comprising about 18.5 wt. % of the non-ionic surfactant.

16. The cleaning formulation of claim 12, comprising about 20 wt. % of the monopropylene glycol.

17. The cleaning formulation of claim 12, comprising about 10 wt. % of the methyl ester.

18. The cleaning formulation of claim 12, comprising about 5 wt. % of the emulsifier.

19. The cleaning formulation of claim 12, comprising about 5 wt. % of the hydroxypropyl sulfonate.

20. The cleaning formulation of claim 12 wherein the non-ionic surfactant is selected from sodium decylglucoside and sodium laurylglucoside.

* * * * *